US005559300A

United States Patent [19]

Fujita

[11] Patent Number: 5,559,300

[45] Date of Patent: Sep. 24, 1996

[54] DELAY TIME MODULATION EFFECTING APPARATUS FOR PROCESSING MUSICAL TONE SIGNAL

[75] Inventor: Yoshio Fujita, Hamamatsu, Japan

[73] Assignee: Yamaha Corporation, Japan

[21] Appl. No.: 300,377

[22] Filed: Sep. 2, 1994

[30] Foreign Application Priority Data

Sep. 3, 1993 [JP] Japan ..... 5-220329

[51] Int. Cl.[6] ..... G10H 1/04; G10H 7/00

[52] U.S. Cl. ..... 84/624; 84/629

[58] Field of Search ..... 84/624, 626, 629, 84/600, 630

[56] References Cited

U.S. PATENT DOCUMENTS 4,569,268 2/1986 Futamase et al. .
5,243,658 9/1993 Sakata ..... 84/624 X

FOREIGN PATENT DOCUMENTS 3-126090 5/1991 Japan .
4-138499 5/1992 Japan .

*Primary Examiner*—William M. Shoop, Jr.
*Assistant Examiner*—Jeffrey W. Donels
*Attorney, Agent, or Firm*—Graham & James LLP

[57] ABSTRACT

A delay-time-modulation effecting apparatus employed by an electronic musical instrument or the like, is designed to effect a certain delay-time modulation on a musical tone signal so as to realize a desired modulation effect appear on a musical tone to be produced. The delay-time modulation is effected in response to a time lag between a write time and a read time at which the musical tone signal is written into and is read from a storage device (e.g., random-access memory). When a read address advances fast to be ahead of the write address, an overmodulation state emerges so that discontinuity in level of the musical tone signals occurs, which will result in an occurrence of noises. In order to avoid such an event, the read address should be limited not to advance ahead of the write address. Herein, the write address is generated in such a manner that the number thereof is circulatorily varied in a lapse of time within a certain address range, while the read address is generated by performing a computation using the modulation data and an offset address. The modulation data is generated in response to a desired modulation effect to be realized. The apparatus provides an address-limit circuit, which is activated when the overmodulation state is detected so that the read address is limited not to advance ahead of the write address. Thus, the occurrence of noises can be avoided.

7 Claims, 11 Drawing Sheets

```
WP > OFP
  ├─ MOD ≧ 0
      ├─ OFP+MOD < ODP
              RP=OFP+MOD                ······ (α)
      └─ OFP+MOD ≧ ODP
              RP=ODP                    ······ (β)
  └─ MOD < 0
      ├─ OFP+MOD ≧ 0
              RP=OFP+MOD                ······ (γ)
      └─ OFP+MOD < 0
          ├─ OFP+MOD+10000 ≧ WP
                RP=OFP+MOD+10000        ······ (δ)
          └─ OFP+MOD+10000 < WP
                RP=ODP                  ······ (ε)
```

FIG. 11

ODP < OFP

- MOD ≧ 0
  - OFP+MOD > FFFF」
    - OFP+MOD- 10000 ≧ ODP
      - RP=OFP+MOD- 10000 ·····(ζ)
    - OFP+MOD- 10000 < ODP
      - RP=ODP ·····(η)
  - OFP+MOD ≦ FFFF
    - RP=OFP+MOD ·····(θ)
- MOD < 0
  - OFP+MOD ≧ WP
    - RP=OFP+MOD ·····(ι)
  - OFP+MOD < WP
    - RP=WP ·····(κ)

FIG. 12

DELAY TIME MODULATION EFFECTING APPARATUS FOR PROCESSING MUSICAL TONE SIGNAL

BACKGROUND OF THE INVENTION

1. Field of the Invention

The present invention relates to a delay-time-modulation effecting apparatus which effects a delay-time modulation on musical tone signals produced by an electronic musical instrument and the like.

2. Prior Art

In the electronic musical instruments recently developed, a variety of musical-tone parameters are controlled in real time. One method for controlling the musical-tone parameters utilizes manual-operable members such as a wheel-type controller and a pedal which are equipped in the electronic musical instrument. Another method utilizes information, given from an external device, such as the information regarding "control change" of the MIDI system (where 'MIDI' is acronym for Musical Instrument Digital Interface). A still another method utilizes an output signal of a low-frequency oscillator (i.e., LFO). Moreover, another technology is recently developed in such a manner that plural pieces of information, which are used to control the musical-tone parameters, are combined together to form complicated modulation information, by which the musical-tone parameters are controlled so that rich expression in the musical performance can be obtained. Such technology is disclosed by the papers of Japanese Patent Laid-Open No. 3-126090 and Japanese Patent Laid-Open No. 4-138499.

By using an effect circuit, which is disclosed by the papers of Japanese Patent Laid-Open No. 58-108583, in the delay-time-modulation effecting apparatus, the delay-time modulation can be performed so that the chorus effect or symphonic effect can be realized. In some cases, however, when using the modulation information which is controlled by a plurality of control members, there is a possibility that the read address advances fast to be ahead of the write address. When the read address advances ahead of the write address, a discontinuity should be occurred in read signals, which may initiate the generation of the noises.

In order to avoid the generation of the noises, the conventional apparatus utilizes offset values or coefficients of modulation which are determined in advance under the consideration of the maximum value (i.e., maximum amplitude) set for modulation signals.

However, if the offset values are determined in response to the maximum amplitude as described above, the amount of delay in the normal frequency range should become large. This causes a relatively large shift in phase between the original sound and the sound artificially produced. In addition, if the coefficients of modulation are determined in response to the maximum amplitude, there is a possibility that the amplitude of the modulation signal in the normal frequency range should be smaller than an instructed value. Thus, in order to limit the maximum amplitude, a range in the variation of the values set by the controller, which controls the musical-tone parameter in real time, should be limited; or a degree of modulation should be limited. However, there is no conventional apparatus which satisfies the above demands.

SUMMARY OF THE INVENTION

It is an object of the present invention to provide a delay-time-modulation effecting apparatus which is capable of performing the delay-time modulation smoothly without limiting the number of the controllers and without limiting the depth of modulation.

A delay-time-modulation effecting apparatus fundamentally comprises an address generating circuit and a storage device (e.g., random-access memory). The address generating circuit generates a read address and a write address. Herein, the write address is generated in such a manner that the number thereof is circulatorily varied in a lapse of time within a certain address range, while the read address is generated by performing a computation using the modulation data and an offset address which is determined in advance in response to the write address. The modulation data is generated in response to a desired modulation effect to be realized. The apparatus provides an address-limit circuit, which is activated when an overmodulation state is detected so that the read address is limited not to advance ahead of the write address.

Under the operation of the address-limit circuit, it is possible to avoid the occurrence of noises which is initiated in the overmodulation state in which the discontinuity in level of the musical tone signals is inevitably occurred.

Further, a visual display can be provided to inform the performer of an occurrence of the overmodulation state.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 11 shows equations which are used to compute the read address under a specific condition; and FIG. 12 shows equations which are used to compute the read address under another specific condition.

DESCRIPTION OF THE PREFERRED EMBODIMENT

Now, a preferred embodiment of the present invention will be described with reference to the drawings.

[A] Overall configuration of the electronic musical instrument

Figure 1:
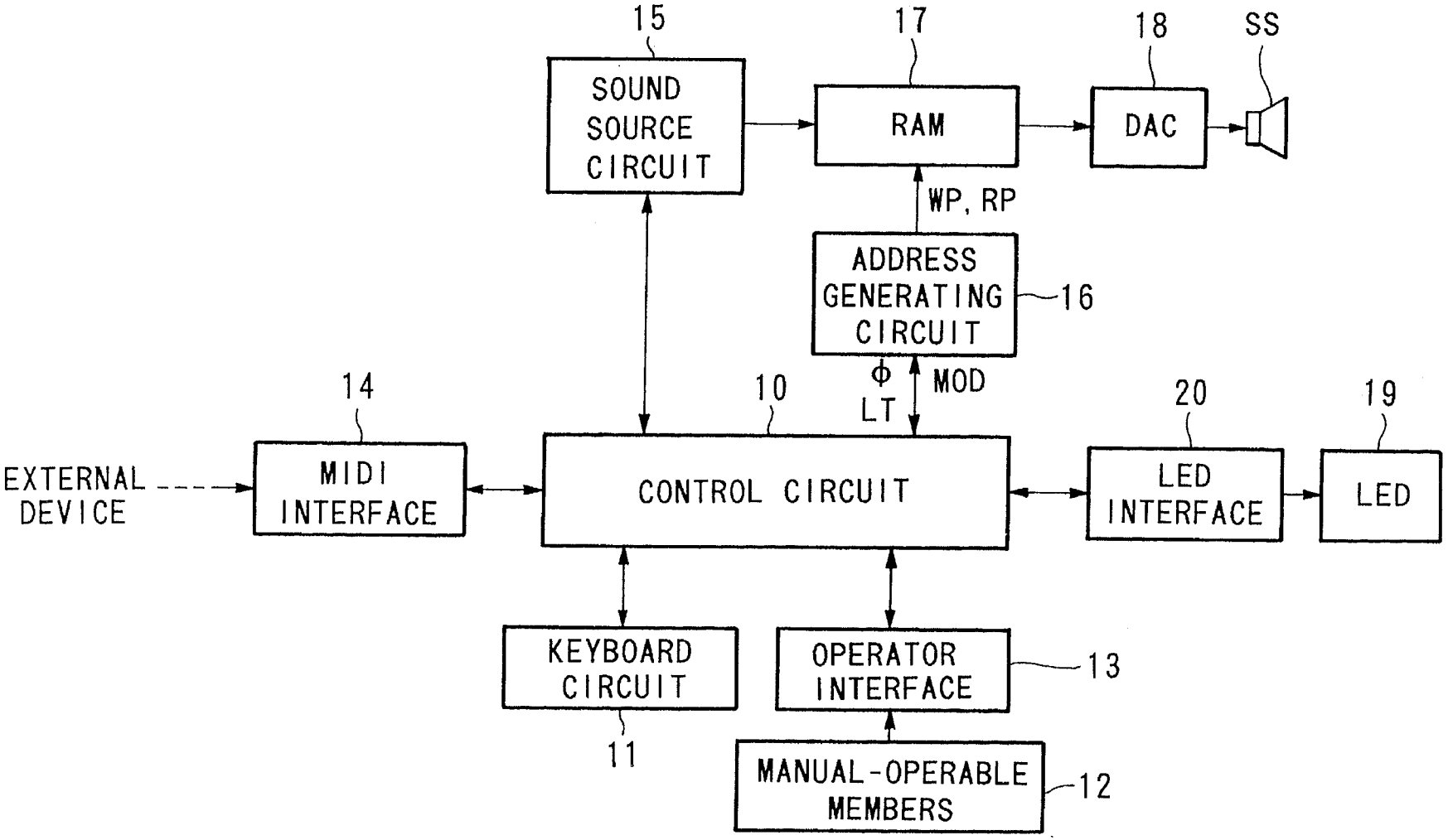
FIG. 1 is a block diagram showing an overall configuration of an electronic musical instrument employing a delay-time-modulation effecting apparatus.

FIG. 1 is a block diagram showing an overall configuration of the electronic musical instrument employing a delay-time-modulation effecting apparatus according to an embodiment of the present invention.

In FIG. 1, a numeral 10 denotes a control circuit which comprises a micro-processor, a read-only memory (i.e., ROM), another memory, a timer and a low-frequency oscillator. The ROM stores control programs to be executed by the micro-processor, while the memory temporarily stores a variety of data. The timer produces a sampling clock $\phi$. The low-frequency oscillator (i.e., LFO) produces waveform data representative of a low-frequency sine wave, for example. A numeral 11 denotes a keyboard circuit which detects key-depression/key-release states for each of the keys, provided in a keyboard (not shown), so as to produce detection information. The detection information is supplied to the control circuit 10.

A numeral 12 represents a variety of manual-operable members. The number of the manual-operable members is set at 'n' (where 'n' is an integral number); in other words, there are provided manual-operable members $\mathbf{12}_1$, $\mathbf{12}_2$, . . ., $\mathbf{12}_n$. Herein, at least two kinds of manual-operable members, such as the pedal and wheel-type controller, are provided. Hence, each of the manual-operable members provides a movable portion. When the performer manipulates the movable portion of each manual-operable member, the each manual-operable member outputs a signal corresponding to the amount of manipulation. Then, the signal outputted from the each manual-operable member is supplied to the control circuit 10 through an operator interface 13 (where a term "interface" is represented by a symbol "I/F").

Figure 2:
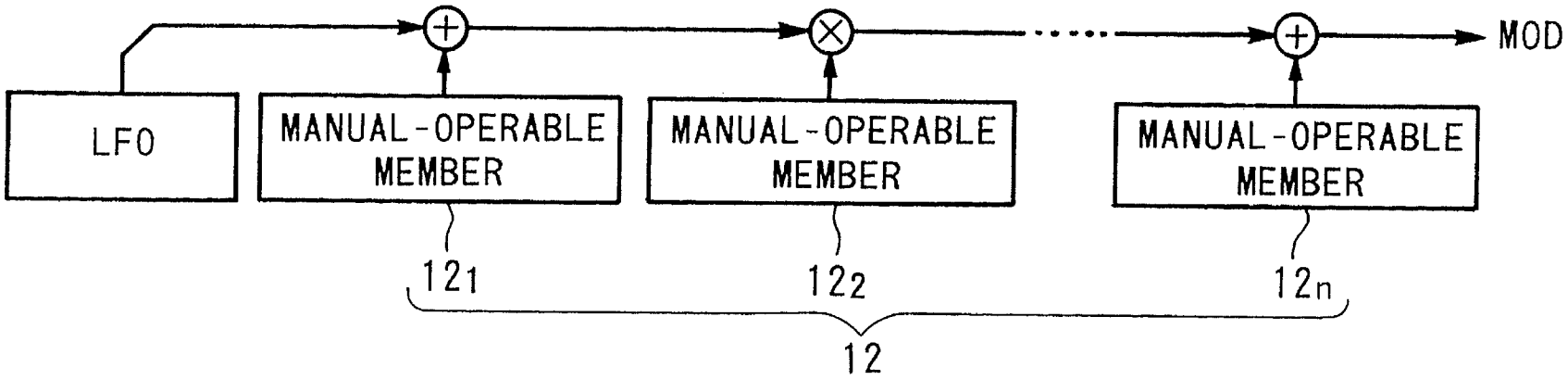
FIG. 2 is a block diagram showing an example of a method to produce modulation data by using the low-frequency oscillator and manual-operable members.

By performing a certain computation, the control circuit 10 combines the signals, respectively outputted from the manual-operable members, and the output signal of the low-frequency oscillator together to form modulation data 'MOD'. FIG. 2 is a block diagram showing an electronic configuration which corresponds to an example of the computation to be performed by the control circuit 10 when producing the modulation data MOD. In FIG. 2, the output signal of the low-frequency oscillator (i.e., LFO) is firstly added to the output signal of the manual-operable member $\mathbf{12}_1$; and then, the result of addition is multiplied by the output signal of the manual-operable member $\mathbf{12}_2$. Incidentally, it is possible to arbitrarily determine as to whether or not the output signal of the low-frequency oscillator is selected or each of the output signals of the manual-operable members is selected. Moreover, by changing the software processing, it is possible to arbitrarily change the contents of the computation as well as a manner of combination among the signals to be used for the computation. Thus, it is possible to obtain a variety of modulation data MOD.

In FIG. 1, a numeral 14 denotes a MIDI interface which is designed in accordance with the standards for MIDI. Through this MIDI interface 14, it is possible to perform a data communication with an external device such as another electronic musical instrument and a sequencer.

By the way, the data, which is given from the external device and is transmitted to the electronic musical instrument shown in FIG. 1 through the MIDI interface 14, can be used as the coefficient of modulation which is used when performing the delay-time modulation. In this case, the data, given from the external device, is treated as similar to the output signal of the manual-operable member.

A numeral 15 denotes a sound source circuit, which produces a quantized musical tone signal under the control of the control circuit 10.

A numeral 16 denotes an address generating circuit which generates a write address 'WP' and a read address 'RP' in accordance with the sampling clock $\phi$. Those addresses are used by a random-access memory (i.e., RAM). This address generating circuit 16 also generates a state signal 'LT' representative of an overmodulation state. Incidentally, a detailed configuration of the address generating circuit 16 will be described later.

One period of the sampling clock $\phi$ is divided into two sections, respectively called a former period and a latter period. Now, the musical tone signal, outputted from the sound source circuit 15, is written into the RAM 17 in the former period, while that musical tone signal is read from the RAM 17 in the latter period.

A numeral 18 denotes a digital-to-analog converter (represented by a symbol 'DAC') which converts the musical tone signal, read from the RAM 17, into an analog signal. This analog signal is supplied to a sound system 'SS' which comprises an amplifier and a speaker. Thus, a musical tone, corresponding to the analog signal, is produced by the sound system SS.

A numeral 19 denotes a light-emitting diode (i.e., LED). The LED 19 is turned on or off by a signal which is supplied from the control circuit 10 through a LED interface 20. This LED 19 is provided to inform the performer as to whether or not the delay-time modulation is in the overmodulation state.

(1) Configuration of address generating circuit 16

Now, the detailed configuration of the address generating circuit 16 will be described with reference to FIG. 3.

Figure 3:
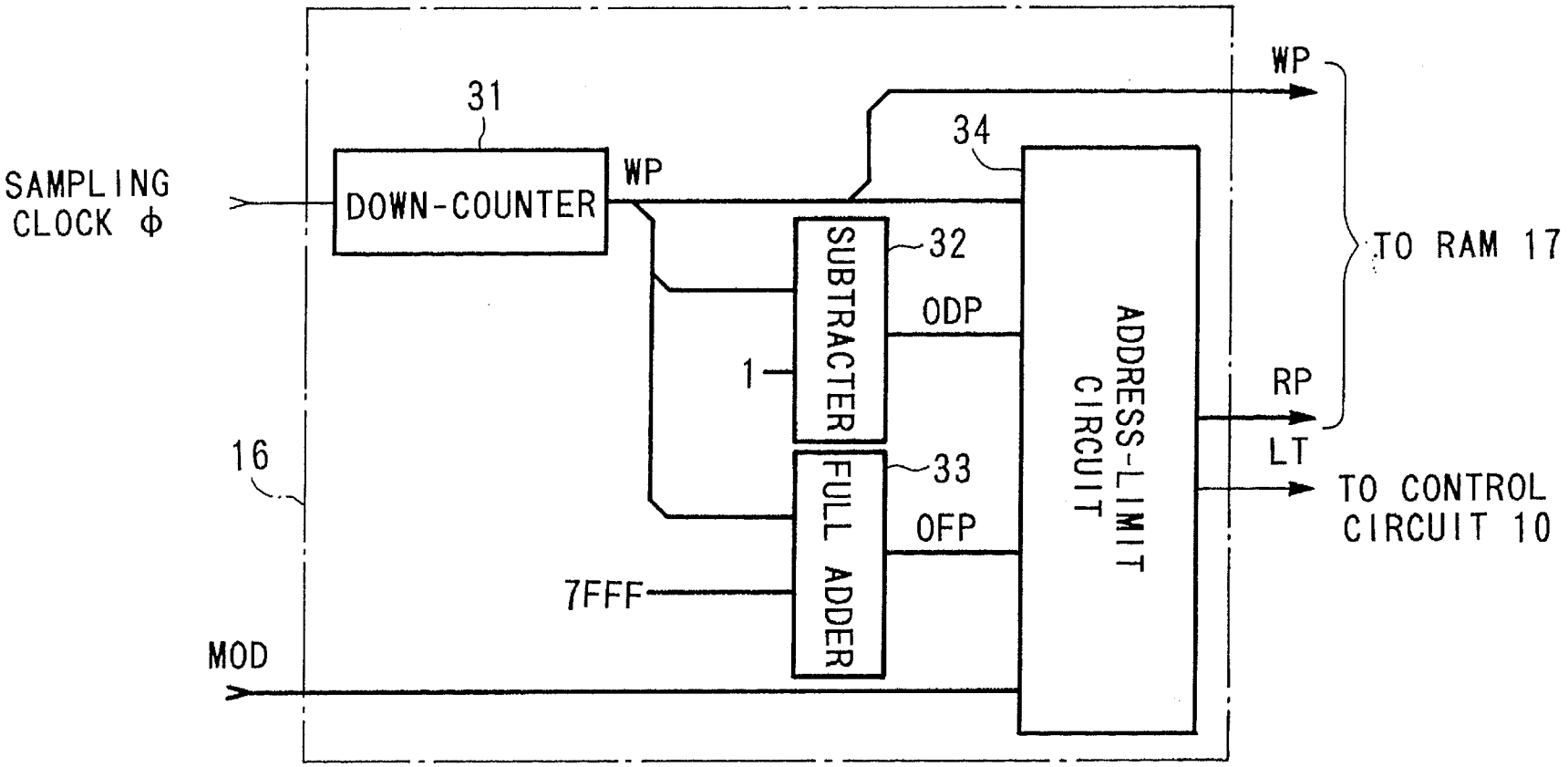
FIG. 3 is a block diagram showing a detailed configuration of an address generating circuit which is a main part of the delay-time-modulation self coating apparatus according to an embodiment of the present invention.

As shown in FIG. 3, the address generating circuit 16 receives the sampling clock $\phi$ and the modulation data MOD from the control circuit (see FIG. 1).

A down-counter 31 decrements a count number by '1' each time the sampling clock $\phi$ is supplied thereto. Then, the result of counting is supplied to the RAM 17 as the write address WP.

The range of the addresses used by the RAM 17 is between numbers '0000' and 'FFFF' (which are represented by the hexadecimal notation).

After the count number of the down-counter 31 reaches '0', the count number is increased to 'FFFF'. So, the down-counter 31 re-starts to count down the count number from the number 'FFFF'.

A subtracter 32 subtracts '1' from the write address WP; and then, the result of subtraction is outputted as a final address 'ODP'.

A full adder 33 adds a number '7FFF' to the write address WP; and then, the result of addition is outputted as an offset address OFP. However, the result of addition is limited by the number 'FFFF'. Hence, if the result of addition exceeds the limit number 'FFFF', an excessive number is outputted as the offset address OFP.

An address-limit circuit 34 generates the read address RP on the basis of the write address WP, the final address ODP, the offset address OFP and the modulation data MOD. In addition, the address-limit circuit 34 also generates the aforementioned state signal LT regarding an indication as to whether or not the delay-time modulation is in the over-modulation state.

(2) Configuration of address-limit circuit 34

The address-limit circuit 34 limits the sum of the offset address OFP and the modulation data MOD, representing the effect of modulation, to a certain number which exists within the range between the write address WP and the final address ODP. Then, the sum of the offset address OFP and the modulation data MOD, limited by the address-limit circuit 34, is outputted as the read address RP.

Next, the detailed configuration of the address-limit circuit 34 will be described with reference to FIG. 4.

Figure 4:
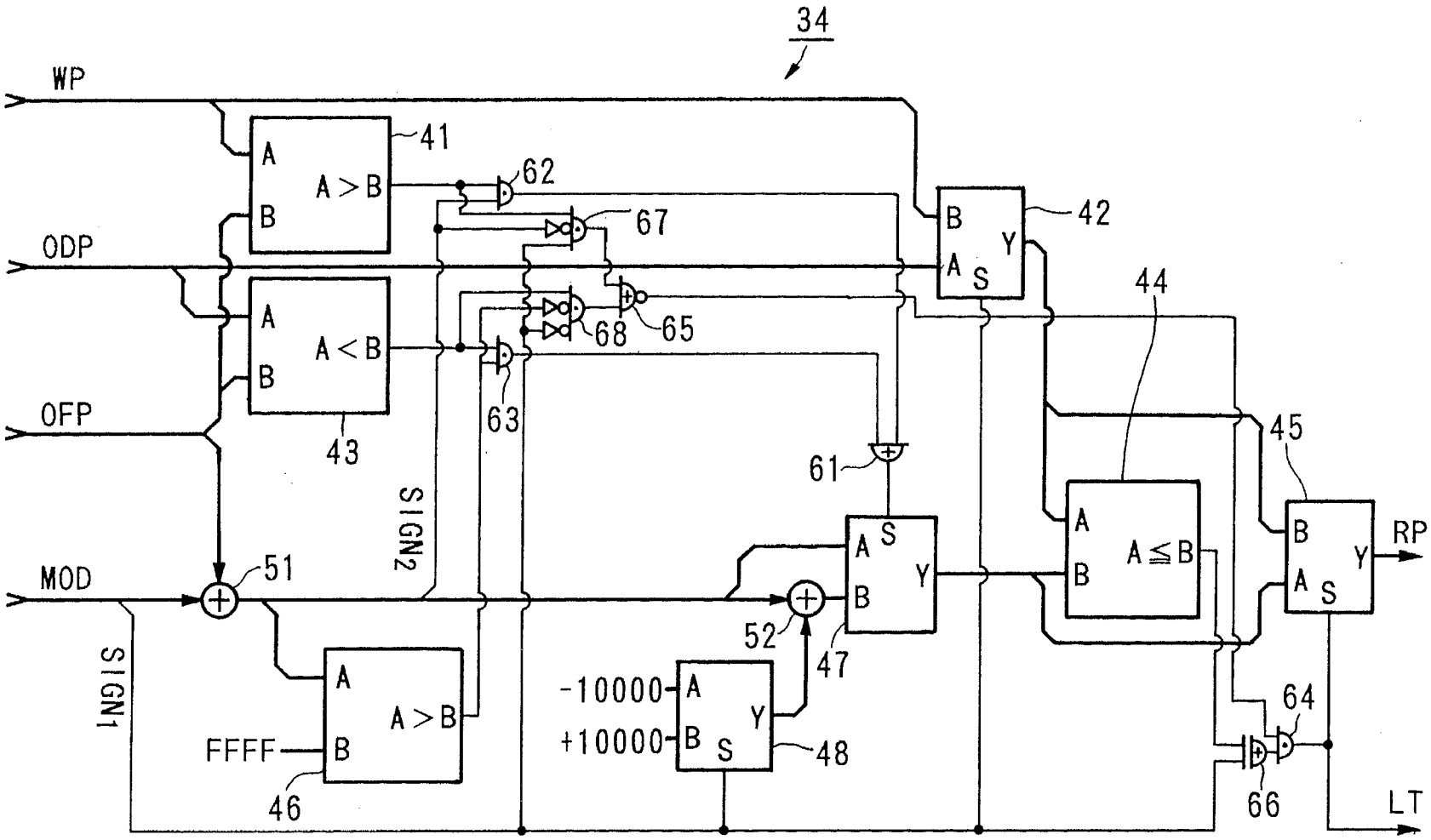
FIG. 4 is a block diagram showing a detailed configuration of an address-limit circuit which is provided in the address generating circuit.

In FIG. 4, the write address WP is delivered to an input terminal 'A' of a comparator 41 and an input terminal 'B' of a selector 42; and the final address ODP is delivered to an input terminal 'A' of a comparator 43 and an input terminal 'A' of the selector 42. The offset address OFP is delivered to an input terminal 'B' of the comparator 41 and an input terminal 'B' of the comparator as well as a first input of an adder 51. The modulation data MOD is supplied to a second input of the adder 51.

Each of the comparators 41 and 43 compares the numbers respectively supplied to the input terminals A and B.

The comparator 41 outputs a result of comparison 'H' (in other words, a signal with a high level) under the condition where the write address WP is greater than the offset address OFP. The comparator 43 outputs a result of comparison 'H' under the condition where the offset address OFP is smaller than the final address ODP.

When a control signal having a high level (simply referred to as a control signal 'H') is supplied to an input terminal 'S' of the selector 42, the selector 42 selects the input terminal B. On the other hand, when receiving a control signal having a low level (simply referred to as a control signal 'L'), the selector 42 selects the input terminal A. Then, the result of the selection, made by the selector 42, is outputted through an output terminal 'Y'. The result of selection is delivered to an input terminal 'A' of a comparator 44 and an input terminal 'B' of a selector 45.

As the above-mentioned control signal, to be supplied to the input terminal S of the selector 42, a most-significant bit '$SIGN_1$' of the modulation data MOD is used. This bit $SIGN_1$ provides an indication as to whether the modulation signal MOD has a positive sign or a negative sign. In the present embodiment, when the modulation data MOD has a negative value, the bit $SIGN_1$ is at 'H' level; hence, the selector 42 selectively outputs the write address WP. In contrast, when the modulation data MOD has a value zero or a positive value, the bit $SIGN_1$ is at 'L' level; hence, the selector 42 selectively outputs the final address ODP.

Meanwhile, the result of addition, produced by the adder 51, in other words, the sum of the offset address OFP and the modulation data MOD, is delivered to all of an input terminal 'A' of a comparator 46, an input terminal 'A' of a selector 47 and a first input of an adder 52. An input terminal 'B' of the comparator 46 receives the maximum address number 'FFFF' for the RAM 17 (see FIG. 1).

Thus, the comparator 46 compares the number 'FFFF' with the result of addition of the adder 51. Namely, the comparator 46 outputs a result of comparison 'H' when the result of addition of the adder 51 is greater than the number 'FFFF'. In short, the comparator 46 makes a judgement as to whether or not the sum of the offset address OFP and the modulation data MOD exceeds the maximum address number 'FFFF' which is set for the RAM 17.

The selector 48 selects an input terminal 'B' when receiving the control signal 'H' at an input terminal 'S'. On the other hand, the selector 48 selects an input terminal 'A' when receiving the control signal 'L'. Then, the result of the selection, made by the selector 48, is supplied to a second input of the adder 52 through an output terminal 'Y'.

As similar to the selector 42, the selector 48 receives the bit $SIGN_1$ as the control signal. Therefore, when the modulation data MOD has the negative value, the selector 48 selectively outputs a number '+10000' which is supplied to the input terminal B. On the other hand, when the modulation data MOD has the value zero or the positive value, the selector 48 selectively outputs a number '−10000' which is supplied to the input terminal A.

The result of addition of the adder 52, i.e., the sum of the result of addition of the adder 51 and the number selectively outputted from the selector 48, is supplied to an input terminal 'B' of the selector 47. The selection, made by the selector 47, is changed over in response to a level of an output signal of an OR gate 61. If the output signal of the OR gate 61 has a 'H' level, the selector 47 selectively outputs the result of addition of the adder 52 which is supplied to the input terminal B. On the other hand, when the output signal of the OR gate 61 has a 'L' level, the selector 47 selectively outputs the result of addition of the adder 51, i.e., the sum of the offset address OFP and the modulation data MOD. The output of the selector 47 is delivered to an input terminal 'B' of the comparator 44 and an input terminal 'A' of the selector 45.

Next, the control signal supplied to the selector 47, i.e., the output signal of the OR gate 61 will be described in detail.

Input terminals of the OR gate 61 receive output signals of AND gates 62 and 63 respectively. A first input of the AND gate 62 receives the result of comparison produced by the comparator 41, while a second input of the AND gate 62 receives a most-significant bit $SIGN_2$ in the digital data representative of the result of addition produced by the adder 51. This most-significant bit $SIGN_2$ indicates either a positive sign or a negative sign. Further, a first input of the AND gate 63 receives the result of comparison produced by the comparator 43, while a second input of the AND gate 63 receives the result of comparison produced by the comparator 46.

The control signal supplied to the selector 47 (i.e., the output signal of the OR gate 61) has a 'H' level under the conditions, described below.

A first condition corresponds to the state where the output signal of the AND gate 62 has a 'H' level. This state emerges when the write address WP is greater than the offset address OFP, and the sum of the offset address OFP and the modulation data MOD is smaller than zero. On the other hand, a second condition corresponds to the state where the output signal of the AND gate 63 has a 'H' level. This state emerges when the final address ODP is smaller than the offset address OFP, and the sum of the offset address OFP and the modulation data MOD is greater than the number 'FFFF'.

Incidentally, the offset address OFP is obtained by adding the number '7FFF' to the write address WP, which will be described later. Therefore, there is no possibility that both of the output signals of the AND gates 62 and 63 simultaneously have the 'H' level.

The comparator 44 compares the output of the selector 42 with the output of the selector 47. This comparator 44 is designed to output a result of comparison 'H' when the output of the selector 42 is equal to or is smaller than the output of the selector 47.

The selector 45 selects the input terminal B, which receives the result of selection produced by the selector 42, when the control signal (i.e., the foregoing state signal LT), supplied to an input terminal S, has a 'H' level. On the other hand, when the control signal 'LT' has a 'L' level, the selector 44 selects the input terminal A which receives the result of selection outputted from the selector 47. Then, the result of selection of the selector 44 is outputted through an output terminal 'Y' as the read address RP, which is then supplied to the RAM 17.

Next, the description will be given with respect to the control signal supplied to the selector 45, i.e., the state signal LT. This state signal LT is outputted from an AND gate 64.

A first input of the AND gate 64 receives an output signal of a NOR gate 65, while a second input of the AND gate 64 receives an output signal of an exclusive-OR gate 66.

A first input of the exclusive-OR gate 66 receives the result of comparison produced by the comparator 44, while a second input of the exclusive-OR gate 66 receives the aforementioned bit SIGN representative of the positive/negative sign of the modulation data MOD.

The NOR gate 65 receives both of output signals of AND gates 67 and 68.

The AND gate 67 provides three inputs. Herein, a first input receives the result of comparison produced by the comparator 41; a second input receives the bit $SIGN_2$, representative of the positive/negative sign in the result of addition of the adder S1, by being inverted; and a third input receives the bit $SIGN_1$ representative of the positive/negative sign of the modulation data MOD.

Similarly, the AND gate 68 provides three inputs. Herein, a first input receives the result of comparison produced by the comparator 48; a second input receives the result of comparison produced by the comparator 46 by being inverted; and a third input receives the bit $SIGN_1$, representative of the positive/negative sign of the modulation data MOD, by being inverted.

In order to turn the level of the state signal LT to the 'H' level so that the selector 4S selects the input terminal B, two conditions (1) and (2), described below, should be simultaneously satisfied.

Namely, the condition (1) corresponds to the state where the output level of the NOR gate 65 is the 'H' level; and the condition (2) corresponds to the state where the output level of the exclusive-OR gate 66 is the 'H' level.

In other words, the condition (2) corresponds to the state where one of the signals supplied to the exclusive-OR gate 66 has the 'H' level. This state emerges when the bit $SIGN_1$ has the 'L' level and the comparator 44 produces the result of comparison 'H'. Or, this state emerges when the bit $SIGN_1$ has the 'H' level and the comparator 44 produces the result of comparison 'L'. Incidentally, the bit $SIGN_1$ has the 'L' level when the modulation data MOD is greater than or equal to zero; and the bit $SIGN_1$ has the 'H' level when the modulation data MOD is smaller than zero.

The aforementioned condition (1) emerges only when both of the output signals of the AND gates 67 and 68, which are supplied to the NOR gate 65, have the 'L' level.

[B] Overall operation of the electronic musical instrument

Next, operations of the electronic musical Instrument will be described.

(1) Main routine

Figure 5:
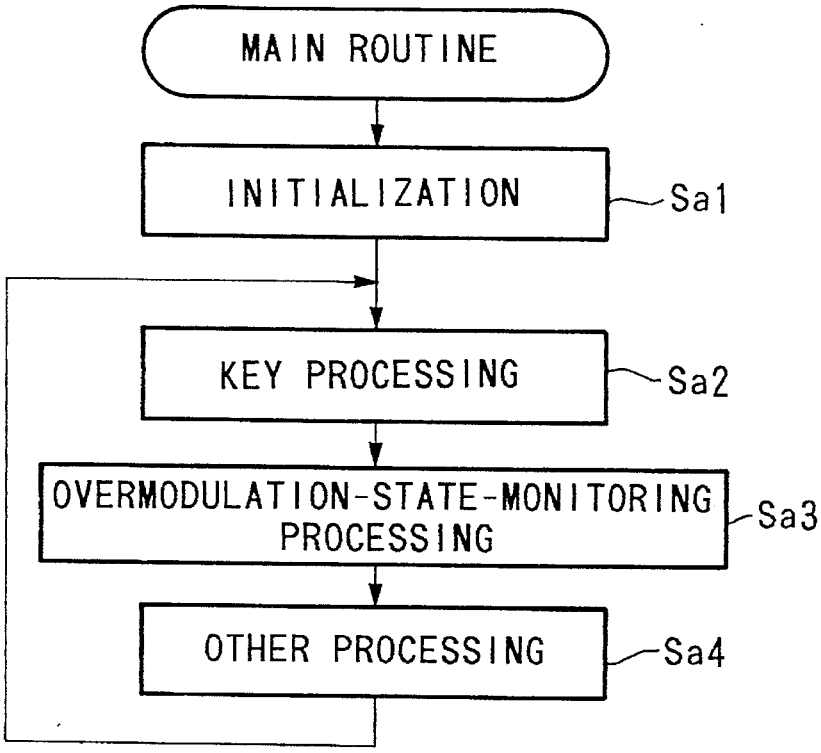
FIG. 5 is a flowchart showing a main routine to be executed by the electronic musical instrument.

At first, when the power is applied to the electronic musical instrument, the main routine, as shown by FIG. 5, is started. The processing of the main routine is executed by a central processing unit (i.e., CPU) provided In the control circuit 10.

In first step Sa1, an initialization processing is performed so that registers, flags and the like, which are set in a memory (or memories) provided in the control circuit 10, are respectively initialized. In the initialization processing, a certain data-setting is performed in such a manner that a previous state, which is the state of the electronic musical instrument emerged before the power supply is broken, is regenerated. After the completion of the initialization processing, the processing of the CPU advances to step Sa2.

In step Sa2, a key processing is executed. In the key processing, the CPU scans key-depression states of the keys, provided in the keyboard (not shown); hence, the result of scanning is stored in the memory of the control circuit 10. In addition, the current result of scanning is compared with the previous result of scanning to find out the key whose operating state is changed; and then, a certain processing is performed on that key. For example, when a key newly depressed is detected, a key-on processing is executed. In contrast, when a key newly released is detected, a key-off processing is executed. In the key-off processing, the musical tone corresponding to the key newly released is muted.

The key-on processing is the processing which is started when a key-depression event of the key in the keyboard is detected. In this processing, the keyboard circuit 11 creates information regarding the key depressed; and then, the information is sent to the control circuit 10. Under the control of the control circuit 10, the information, regarding the key depressed, and tone-color information are sent to the sound source circuit 15. The tone-color information has been already set by operating a tone-color setting member or the like. Thus, the sound source circuit 15 produces a musical tone signal on the basis of the key, which is currently depressed, and the tone color which has been already set. Then, the musical tone signal is supplied to the RAM 17.

The sound source circuit 15 can be designed to operate in accordance with a time-division system so that a plurality of channels can be activated, wherein each channel is used to produce one musical tone signal. In that case, when the key-depression event is detected, the control circuit 10 searches an idle channel from among the channels of the sound source circuit 15. The idle channel is the channel which is in a stand-by state for waiting a tone-generation instruction; in other words, the idle channel is the channel to which a new tone-generation task can be assigned. If the idle channel is found, a tone-generation task regarding the generation of the musical tone signal corresponding to the depressed key is assigned to that channel. On the other hand, if no idle channel exists among the channels of the sound source circuit 15, the control circuit 10 selects one of the channels, whose progression in the tone-generation task is mostly advanced. Then, the selected channel is forced to be set as an idle channel; hence, the task for generating the musical tone is assigned to that idle channel. In this case, the control circuit 10 sends a pair of the information, regarding the depressed key, and the tone-color information to the above-mentioned idle channel.

Therefore, even if a plurality of keys are simultaneously depressed, the idle channels in the sound source circuit 15 can be simultaneously activated to generate respective musical tone signals in the certain tone color in accordance with the keys depressed. Herein, the musical tone signals, respectively generated by the channels, are accumulated by an accumulator (not shown) in each period of the sampling clock $\phi$; and then, the musical tone signals accumulated are supplied to the RAM 17.

As described above, the musical tone signal is generated by the key processing in step Sa2. The musical tone signal is once written into the RAM 17 by the write address WP; and then, the musical tone signal is read from the RAM 17 by the read address RP. The musical tone signal, read from the RAM 17, is supplied to the DAC 18. In the DAC 18, the musical tone signal is converted into an analog signal. Thus, the sound system SS produces the musical tone corresponding to the analog signal. In that case, a certain delay-time modulation is effected on the musical tone signal generated by the sound source circuit 15 before the corresponding musical tone is produced by the sound system SS.

In step Sa3, an overmodulation-state-monitoring processing is executed in response to the level of the state signal LT which is outputted from the address generating circuit 16, in other words, which is outputted from the address-limit circuit 34 shown in FIG. 4. The details of this processing will be described later.

In step Sa4, other processing is executed. Herein, data regarding a setting state of switches and controls arranged on a panel face (not shown) of the electronic musical instrument are written into corresponding registers which are set in the memory of the control circuit 10.

Moreover, a computation for computing the modulation data MOD is also performed in step Sa4. Under the operations of the step Sa4, by operating the switches and controls provided on the panel face, it is possible to determine a setting state for the manual-operable members $\mathbf{12}_1$ to $\mathbf{12}_n$ and an output waveform of the low-frequency oscillator as well as a the computation method. Thus, a desired algorithm for the computation is established in the control circuit 10; hence, the modulation data MOD is computed and is supplied to the address generating circuit 16.

After the completion of the step Sa4, the processing of the CPU returns to the foregoing step Sa2. Thereafter, a group of the steps Sa2 to Sa4 is repeatedly executed until the power supply is shut down.

In the main routine described above, a group of the key processing, overmodulation-state-monitoring processing and other processing is repeatedly executed. Therefore, the modulation data MOD to be computed can be varied in real time in accordance with the output signal of the low-frequency oscillator as well as the setting state for the manual-operable members.

(1) Routine of overmodulation-state-monitoring processing

Figure 6:
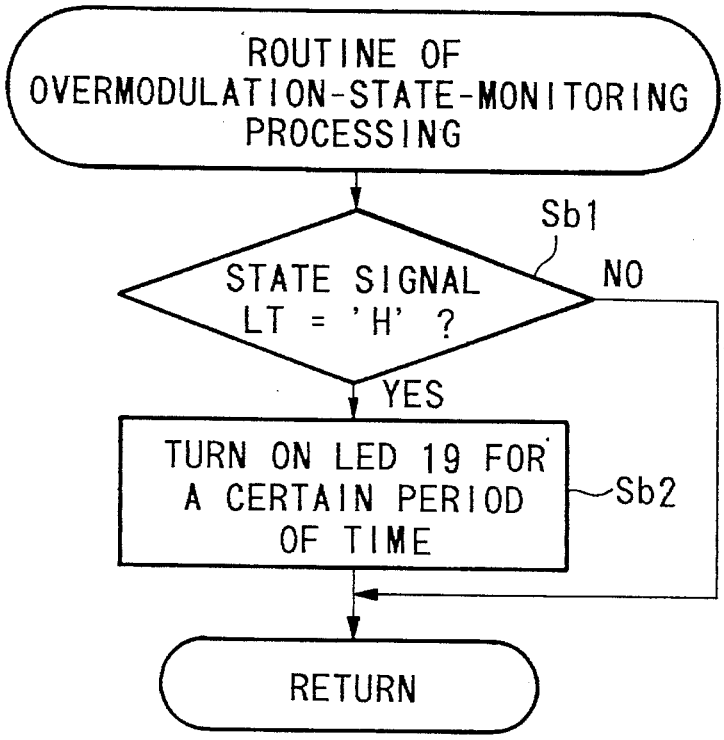
FIG. 6 is a flowchart showing a routine of overmodulation-state-monitoring processing to be executed by the electronic musical instrument.

When the processing of the CPU reaches the step Sa3 in the main routine, the overmodulation-state-monitoring processing, as shown in FIG. 6, is started.

When this processing is started, a step Sb1 is activated, so that a judgement is made as to whether or not the state signal LT has the 'H' level. In the case where the state signal LT has the 'L' level, the sum of the offset address OFP and the modulation data MOD (or an excessive number of that sum which exceeds a predetermined address range) is used as the read address RP. In that case, there is no need to execute any processing; hence, the execution of this routine is immediately ended.

On the other hand, the state signal LT has the 'H' level under the situation where the modulation data MOD is excessive. So, in order to inform the performer of that situation, the control circuit 10 turns on the LED 20 for a certain period of time in step Sb2. The processing of step Sb2 can be realized as described below.

A desired number is written in a certain register at first; and then, every time the routine of overmodulation-state-monitoring processing is started, that number is decremented. So, the LED 20 is controlled to be turned on as long as the number decremented is larger than zero.

After the completion of the step Sa2, the execution of the routine of overmodulation-state-monitoring processing is ended. Then, the processing of the CPU returns to the main routine (see FIG. 5).

As described above, in the routine of overmodulation-state-monitoring processing, an indication for the overmodulation state is carried out as long as the state signal LT has the 'H' level. This indication calls a performer's attention to the occurrence of the overmodulation state.

[C] Operations of each portion in electronic musical instrument

Next, the detailed description will be given with respect to the operations of each portion in the electronic musical instrument, particularly to the operations of each of the circuit portions which contribute to the delay-time modulation.

(1) Address generating circuit 16

Figure 7:
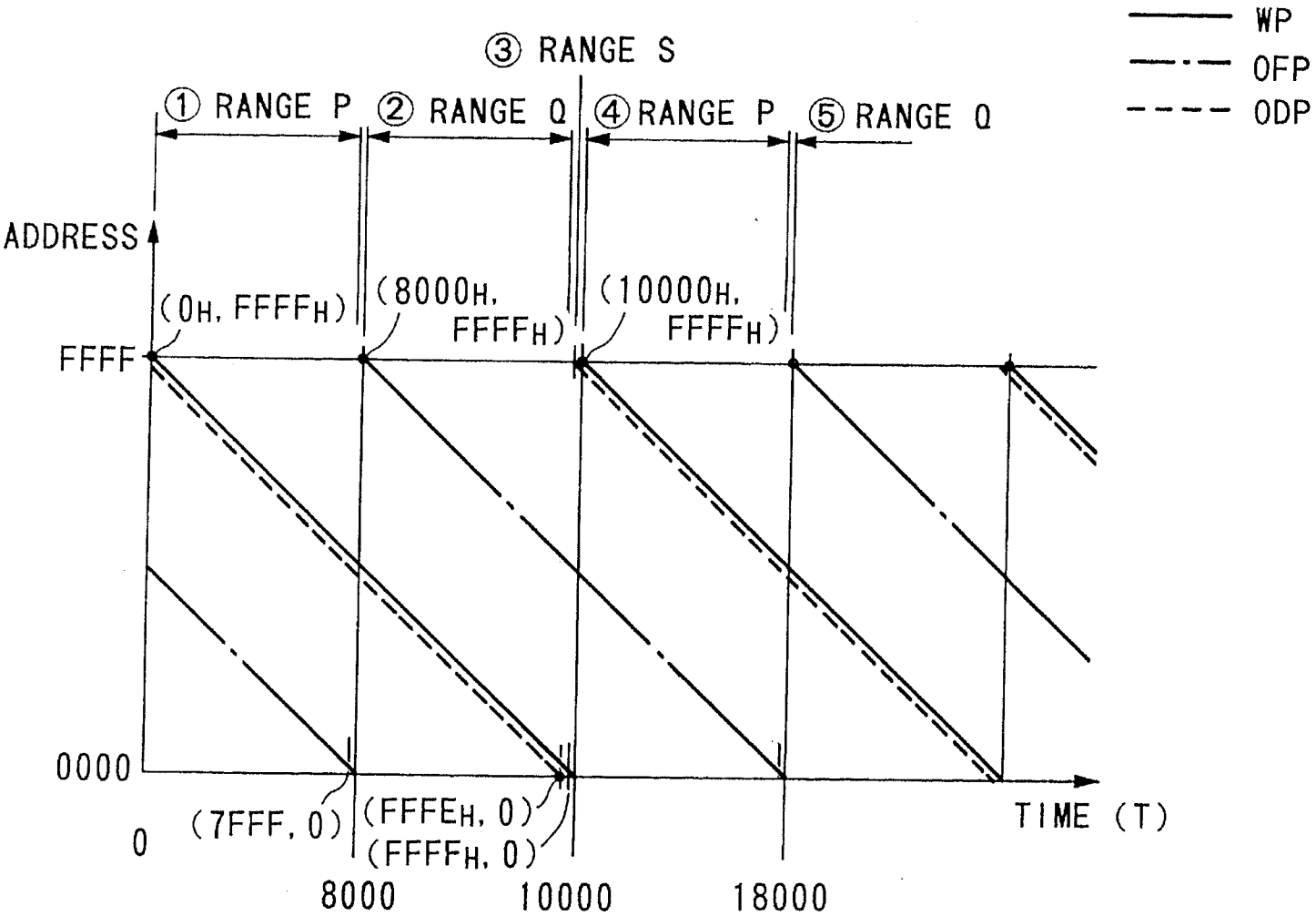
FIG. 7 is a graph showing a relationship among manners of variation of a write address, an offset address and a final address.

Firstly, the operations of the address generating circuit 16, shown in FIG. 3, will be described in detail with reference to FIG. 7. FIG. 7 shows a manner of variation for the address, generated by the address generating circuit 16, with respect to time. For convenience's sake, each interval of time on the axis of time (T) is related to the period of the sampling clock $\phi$ and is expressed in the hexadecimal notation. An initial number 'FFFF' is set for the write address WP at a moment '0' on the axis of time (T).

The write address WP is counted down In response to the sampling clock $\phi$. Hence, after a certain number (represented by 'FFFF') of the periods of the sampling clock $\phi$ are passed from the moment '0', the write address WP is counted down to zero which is represented by '0000' in the hexadecimal notation. Then, at a next period of the sampling clock $\phi$, i.e., at a '10000'-th period of the sampling clock $\phi$, the write address WP is counted down again from the number 'FFFF'. Such down-counting is repeatedly performed. Therefore, the write address WP is varied from 'FFFF' to '0000' in a lapse of time.

As compared to the down-counting for the write address WP, the down-counting for the final address ODP is advanced by a certain time which is indicated by a value '1'. In other words, the final address ODP should be delayed behind the write address WP by the number 'FFFF' which corresponds to the maximum address of the RAM 17 (see FIG. 1). The musical tone signal is written into the RAM 17 by the write address WP; and then, that musical tone signal is read from the final address ODP. Thus, it is possible to obtain a maximum delay time for the musical tone signal.

Or, the musical tone signal is written by the write address in a former-half period of the sampling clock $\phi$; and then, that musical tone signal is read from the address which is identical to the write address WP. In this case, it is possible to minimize the delay time to zero.

The read address RP, which corresponds to the write address WP, can be shifted within a range between '0000' and 'FFFF'.

As compared to the down-counting of the write address WP, the down-counting of the offset address OFP is delayed by a certain number (represented by a number '7FFF') of the periods of the sampling clock $\phi$. Therefore, as shown by a graph of FIG. 7, an inclination of a dashed line, which indicates a manner of variation of the offset address ODP, is identical to that of a full line, which indicates a variation of the write address WP; whereas one dashed line is located at a mid-place between two full lines.

In accordance with the down-counting for the number of the periods of the sampling clock $\phi$, the write address WP is changed within a range, represented by an inequality of "FFFF≧WP≧0000". In addition, the final address ODP is given by an equation of "ODP=WP-1", while the offset address OFP is given by an equation of "OFP=WP+7FFF". Therefore, if the write address WP is in a range 'P', represented by an inequality of "FFFF≧WP>8000", the final address ODP and the offset address OFP belong to respective ranges as follows.

FFFE≧ODP>7FFF

7FFE≧OFP>0000

In other words, as long as the write address WP exists in the above-mentioned range P, the following inequalities are established.

WP>ODP

ODP>OFP

In this situation, the comparator 41 produces the result of comparison 'H', while the comparator 43 produces the result of comparison 'L'.

Meanwhile, if the write address WP Is in a range 'Q', represented by an inequality of "8000≧WP>0000", the final address ODP and the offset address OFP belong to respective ranges as follows.

7FFF≧ODP≧0000

FFFF≧OFP>7FFF

Therefore, as long as the write address WP exists in the range Q, the following inequalities are established.

WP≦ODP

ODP<OFP

In that ease, the comparator 41 produces the result of comparison 'L', while the comparator 43 produces the result of comparison 'H'.

By the way, when an equation of "WP=0" is established in connection with the write address WP, the following equations are established.

ODP=FFFF

OFP=7FFF

In that case, both of the comparators 41 and 43 produce the same result of comparison 'L'. For convenience's sake, the state where the write address WP is equal to zero will be related to a range S. So, when the write address WP exists in the range S, the above-mentioned equations are established.

Since the number 'FFFF' is set for the write address WP at the moment '0' in FIG. 7, each of the ranges can be defined by each of durations as follows, wherein each duration exists between two moments, each represented by a certain hexadecimal number.

① Range P: '0'~'7FFF'
② Range Q: '8000'~'FFFE'
③Range S: 'FFFF'
④ Range P: '10000'~'17FFF'
⑤ Range Q: '18000'~'1FFFE'
⑥ Range S: '1FFFF'

(2) Address-limit circuit 34

As described before, the modulation data MOD is produced in accordance with the output signal of the low-frequency oscillator and the signal corresponding to the amount of manipulation applied to each of the manual-operable members $\mathbf{12}_1$ to $\mathbf{12}_n$. In order to simplify the explanation, it is assumed that certain waveform data, representing the sine wave, is used as the modulation data MOD. In this waveform data, the range of variation exceeds the number 'FFFF'; and the period is smaller than a product of the multiplication performed between the number '7FFF' and the period of the sampling clock $\phi$.

Figure 8A:
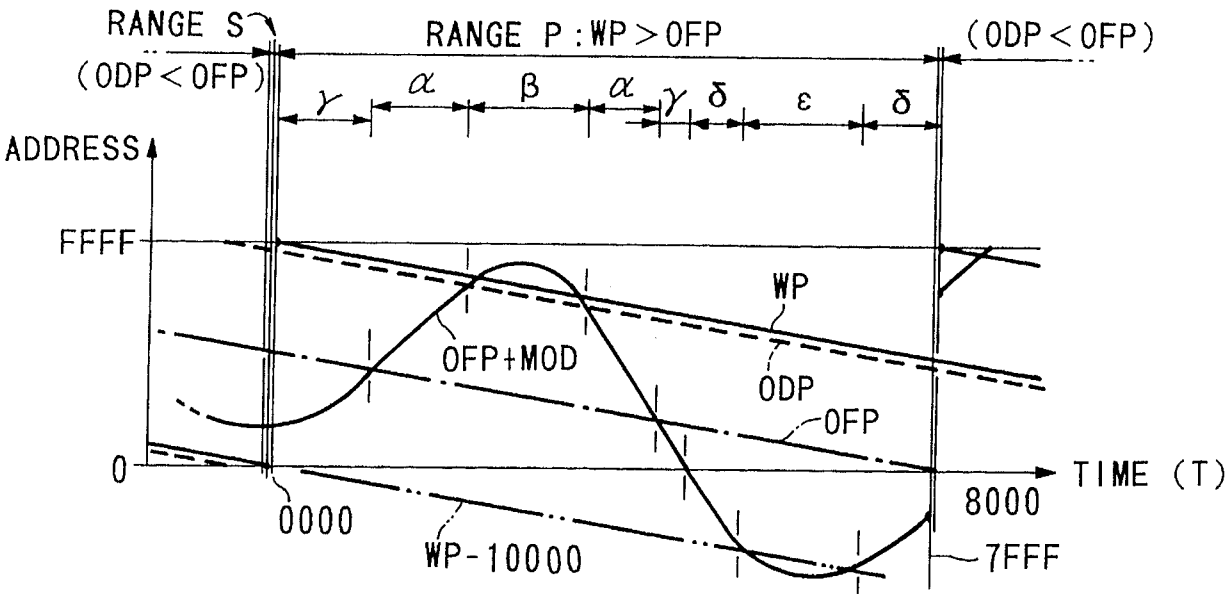
FIGS. 8A and 8B are graphs which are used to explain a manner of variation, in a range P, of the read address, whose number is limited by the address-limit circuit.
Figure 9A:
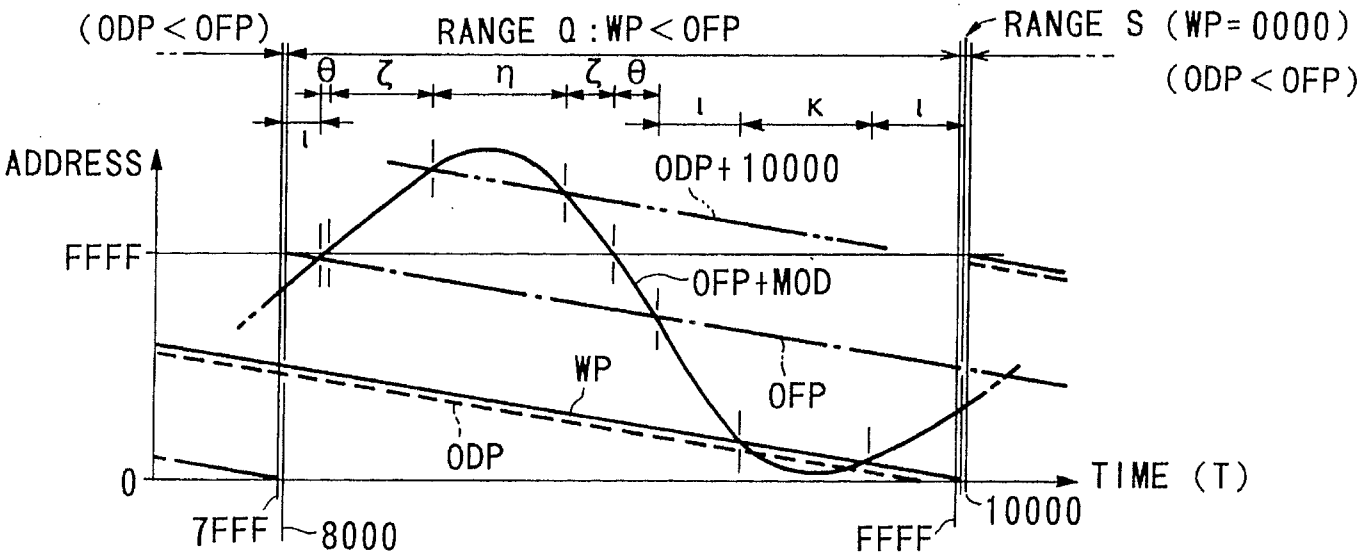
FIGS. 9A and 9B are graphs which are used to explain a manner of variation, in a range Q, of the read address whose number is limited by the address-limit circuit.

As shown in FIG. 4, the modulation data MOD is added to the offset address OFP by the adder 51. Thus, it can be said that the modulation data MOD is changed relatively in connection with the offset address OFP. Namely, if the write address WP exists in the range P, the sum of the modulation data MOD and the offset address OFP changes as shown in FIG. 8A. On the other hand, if the write address WP exists in the range Q, the above-mentioned sum changes as shown in FIG. 9A.

Now, the operations of the address-limit circuit 34 will be described with respect to the ranges P and Q in turn. In each range, the address-limit circuit 34 operates differently in response to the sign in the value of the modulation data MOD. After describing them in connection with both of the ranges P and Q, the operations of the address-limit circuit 34 will be described with respect to the range S where the write address WP is equal to '0000'.

(a) Range P

In the case where the write address WP exists in the range P, the comparator 41 outputs the result of comparison 'H' but the comparator 43 outputs the result of comparison 'L' as described before. In that case, both of the AND gates 63 and 68 produce the output signal 'L'.

① First situation where MOD≧0 ($\alpha$, $\beta$)

The first situation, where the modulation data MOD is greater than or equal to zero, corresponds to durations $\alpha$ and $\beta$ shown in FIG. 8A. In that situation, the bit $SIGN_1$ has the 'L' level. Hence, the selector 42 selects the input terminal A, so that the final address ODP is delivered to the input terminal A of the comparator 44 and the input terminal B of the selector 45.

In this situation, the range of the values, which can be set for the offset address OFP, is between '0000' and 'FFFF'. Under the consideration of this range, the following inequality is obtained.

$$OFP+MOD \geqq 0$$

In other words, the sum of the offset address OFP and the modulation data MOD is greater than or equal to zero. Thus, the bit $SIGN_2$ should have the 'L' level.

So, the output signal of the AND gate 62 is now having the 'L' level. Since the output level of the AND gate 63 has been already set at the 'L' level, the output level of the OR gate 61 is turned to be at the 'L' level. As a result, the selector 47 selects the input terminal A, so that the sum of the offset address OFP and the modulation data MOD is delivered to the input terminal B of the comparator 44 and the input terminal A of the selector 45.

Since the bit $SIGN_1$ has the 'L' level, the output level of the AND gate 67 turns to be at the 'L' level. In addition, since the output level of the AND gate 68 has been already set at the 'L' level, the output level of the NOR gate 65 turns to be at the 'H' level.

One input of the exclusive-OR gate 66 receives the bit $SIGN_1$ which is now at the 'L' level, while one input of the AND gate 64 receives the output signal of the NOR gate 65 which is now at the 'H' level. Hence, the level of the state signal LT depends upon the result of comparison outputted from the comparator 44.

As described before, the final address ODP is supplied to the input terminal A of the comparator 44, while the sum of the offset address OFP and the modulation data MOD is supplied to the input terminal B of the comparator 44. Therefore, the relationship between the numbers respectively supplied to the input terminals A and B of the comparator 44 will determine the level of the state signal LT and the read address RP.

Next, the operations of the circuitry shown in FIG. 4 will be described in detail in connection with each of the numerical states which are represented by inequalities among the numbers ODP, OFP and MOD.

(i) First state where ODP>OFP+MOD ($\alpha$)

The first state, where the final address ODP is greater than the sum of the offset address OFP and the modulation data MOD, corresponds to the duration $\alpha$ (see FIG. 8A). In that state, the comparator 44 outputs the result of comparison 'L', so that the state signal LT is set at the 'L' level; hence, the selector 45 selects the input terminal A.

As a result, the following equation among the read address RP, the offset address OFP and the modulation data MOD is established.

$$RP=OFP+MOD$$

Thus, the musical tone signal is read from the RAM 17 (see FIG. 1) in response to the above-defined read address RP.

(ii) Second state where ODP≦OFP+MOD ($\beta$)

The second state, where the final address ODP is smaller than or equal to the sum of the offset address OFP and the modulation data MOD, corresponds to the duration $\beta$ (see FIG. 8A). In that state, the comparator 44 outputs the result of comparison 'H'. Hence, the state signal LT is set at the 'H' level, so that the selector 45 selects the input terminal B.

As a result, the following equation between the read address RP and the final address ODP is established.

$$RP=ODP$$

Thus, the musical tone signal is read from the RAM in response to the above-defined read address RP.

By the way, the duration $\beta$ indicates an event in which the write address WP advances ahead of the read address RP because of the relatively small speed in the decrease of the read address RP.

However, the present embodiment is designed such that in the duration $\beta$, the read address RP is replaced by the final address ODP which indicates the longest delay time. So, it is possible to avoid the discontinuity in level of the musical tone signals to be read out.

② Second situation where MOD<0 ($\gamma$,$\delta$, $\epsilon$)

Next, the operations of the address-limit circuit 34 will be described in detail with respect to the second situation where the modulation data MOD is smaller than zero. In the second situation, the write address WP exists in the range P, but the sign of the modulation data MOD is negative.

The second situation corresponds to durations $\gamma$, $\delta$ and $\delta$ (see FIG. 8A). In that situation, the bit $SIGN_1$ is set at the 'H' level. Thus, the selector 42 selects the input terminal B, so that the write address WP is delivered to the input terminal A of the comparator 44 and the input terminal B of the selector 45.

The selection of the input terminal in the selector 47 depends upon the positive/negative sign in the sum of the offset address OFP and the modulation data MOD. Meanwhile, the output level of the AND gate 63 has been already set at the 'L' level, while one input of the AND gate 62 receives the signal (i.e., the result of comparison outputted from the comparator 41) which has been already set at the 'H' level. As a result, the output level of the OR gate 61 depends upon the bit $SIGN_2$ only.

Similarly, the output level of the NOR gate 65, in other words, the signal level applied to one input of the AND gate 64, depends upon the positive/negative sign in the sum of the offset address ODP and the modulation data MOD. This is because the output level of the AND gate 68 has been already set at the 'L' level and both of the signals respectively supplied to the first and third inputs of the AND gate 67 have the 'H' level.

Next, the operations of the address-limit circuit 34 will be described in detail with respect to the states, each of which corresponds to the positive/negative sign in the sum of the offset address OFP and the modulation data MOD.

(i) First state where OFP+MOD≧0 ($\gamma$)

The first state, where the sum of the offset address OFP and the modulation data MOD is greater than or equal to zero, corresponds to the duration $\gamma$ (see FIG. 8A).

In that state, the bit $SIGN_2$ is set at the 'L' level. Hence, the output signal of the AND gate 62 is now having the 'L' level. Therefore, the output signal of the OR gate 61 has the 'L' level, so that the selector 47 selects the input terminal A. So, the sum of the offset address OFP and the modulation data MOD is supplied to the input terminal A of the selector 45.

Since the bit $SIGN_2$ has the 'L' level, the output level of the AND gate 67 turns to be at the 'H' level. Therefore, the output signal of the NOR gate 65 is set at the 'L' level. Thus, the selector 45 will normally select the input terminal A, regardless of the result of comparison outputted from the comparator 44.

As a result, the following equation is established among the read address RP, the offset address OFP and the modulation data MOD.

$RP=OFP+MOD$

Thus, the musical tone signal is read from the RAM 17 in response to the above-defined read address RP.

(ii) Second state where OFP+MOD<0 (δ, ϵ)

Next, the description will be given with respect to the second state where the sum of the offset address OFP and the modulation data MOD is in the negative sign.

In that state, the bit $SIGN_2$ is set at the 'H' level. Therefore, the AND gate 62 produces the output level 'H'. This turns the output level of the OR gate 61 to be at the 'H' level. Hence, the selector 47 selects the input terminal B. On the other hand, the bit $SIGN_1$ is also set at the 'H' level. Thus, the selector 48 selects the input terminal B, so that the number '+10000' is supplied to one input of the adder 52.

The adder 52 outputs sum data indicating the sum of the offset address OFP, the modulation data MOD and the number '+10000'. This sum data is supplied to the input terminal B of the selector 47, through which the sum data is delivered to the input terminal B of the comparator 44 and the input terminal A of the selector 45.

Because of the 'H' level of the bit $SIGN_2$, the AND gate 67 produces the output level 'L', while the NOR gate 65 produces the output level 'H'.

Meanwhile, one input of the exclusive-OR gate 66 receives the bit $SIGN_1$ which is now set at the 'H' level. As a result, the level of the state signal LT depends upon the result of comparison outputted from the comparator 44.

As described before, the write address WP is supplied to the input terminal A of the comparator 44, while the sum data is supplied to the input terminal B of the comparator 44. Thus, the level of the state signal LT depends upon the relationship between the numbers respectively supplied to the input terminals A and B of the comparator 44; in other words, the read address RP is determined by that relationship.

Next, the operations of the circuitry shown in FIG. 4 will be described in detail in connection with each of numerical states which are represented by inequalities for the write address WP against the sum of the offset address OFP, the modulation data MOD and the number '10000'.

(i) First state where WP≦OFP+MOD+'10000' (δ)

The first state, where the write address WP is smaller than or equal to the sum of the offset address OFP, the modulation data MOD and the number '10000', corresponds to the duration δ in which in FIG. 8A, a curve "OFP+MOD" is above a line "WP-10000" but is less than '0'. In that state, the comparator 44 outputs the result of comparison 'H'; hence, the state signal LT has the 'L' level. Thus, the selector 45 selects the input terminal A. As a result, the following equation is established among the read address WP, the offset address OFP, the modulation data MOD and the number '10000'.

$WP=OFP+MOD+'10000'$

Thus, the musical tone signal is read from the RAM 17 in response to the above-defined read address RP.

(ii) Second state where WP>OFP+MOD+'10000' (ϵ)

The second state, where the write address WP is greater than the sum of the offset address OFP, the modulation data MOD and the number '10000', corresponds to the duration ϵ in which in FIG. 8A, the curve "OFP+MOD" is below the line "WP-10000". In that state, the comparator 44 outputs the result of comparison 'L'; hence, the state signal LT has the 'H' level. Therefore, the selector 45 selects the input terminal B. As a result, the following equation is established between the read address RP and the write address WP.

$RP=WP$

Thus, the musical tone signal is read from the RAM 17 in response to the above-defined read address RP.

In the above-mentioned duration ϵ, the read address RP advances ahead of the write address WP because of the relatively large speed in the decrease of the read address RP. However, the present embodiment is designed such that in the duration ϵ, instead of the read address RP, the write address WP indicating the shortest delay time (i.e., zero) Is used as the read address. Thus, it is possible to avoid the discontinuity in level of the musical tone signals to be read out.

Figure 8B:
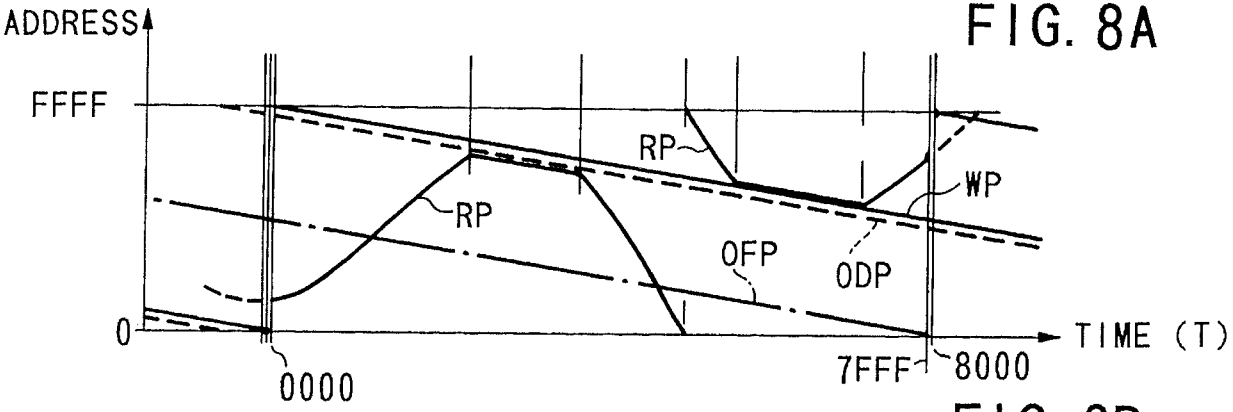

FIG. 8B shows a manner of variation of the read address RP, wherein FIG. 8B corresponds to FIG. 8A. FIG. 11 shows an example of the relationship among the durations α to ϵ in connection with the situation where WP>OFP. In this situation, the durations α and β emerge under the state where MOD≧0, while the durations γ, δ and ϵ emerge under the state where MOD<0. Herein, the equation for the computation of the read address RP is described with respect to each duration.

(b) Range Q

Next, the description will be given with respect to the case where the write address WP exists in the range Q. In this case, the comparator 41 outputs the result of comparison 'L' and the comparator 43 outputs the result of comparison 'H'; hence, both of the AND gates 62 and 67 produce the output level 'L'.

Next, the operations of the circuitry shown in FIG. 4 will be described in detail in connection with the positive/negative sign of the modulation data MOD.

① First situation where MOD≧0 (ζ, η and θ)

The first situation, where the modulation data MOD is greater than or equal to zero, corresponds to durations ζ, η and θ (see FIG. 9A). In that situation, the bit $SIGN_1$ has the 'L' level. Thus, the selector 42 selects the input terminal A, so that the final address ODP is delivered to the input terminal A of the comparator 44 and the input terminal B of the selector 45.

The selection of the input terminal in the selector 47 depends upon the result of comparison of the comparator 46. This is because the output level of the AND gate 62 has been already set at the 'L' level and one input of the AND gate 63 receives the signal (i.e., the result of comparison of the comparator 43) whose level has been already set at the 'H' level.

Similarly, the output level of the NOR gate 65, in other words, the signal level applied to one input of the AND gate 64, also depends upon the result of comparison of the comparator 46. This is because the output level of the OR gate 67 has been already set at the 'L' level and both of the first and third inputs of the AND gate 68 receive the respective signals whose levels have been already set at the 'H' level.

Next, the operations of the circuitry shown in FIG. 4 will be described in detail in connection with the result of comparison of the comparator 46.

①—1 First condition where OFP+MOD>'FFFF' (ζ and η)

In the first condition, the comparator 46 outputs the result of comparison 'H'. In that condition, the output level of the AND gate 63 is set at the 'H' level. Therefore, the output signal of the OR gate 61 has the 'H' level, so that the selector 47 selects the input terminal B.

In the first condition, the bit $SIGN_1$ has the 'L' level. Hence, the selector 48 selects the input terminal A, so that the number '−10000' is supplied to one input of the adder 52. The adder 52 outputs sum data representative of the sum of the offset address OFP, the modulation data MOD and the number '−10000'. This sum data is delivered to the input terminal B of the comparator 44 and the input terminal A of the selector 45 through the input terminal B of the selector 47. The sum data corresponds to the excessive number by which the address exceeds the range of address which is determined for the RAM 17 in advance.

Since the comparator 46 outputs the result of comparison 'H', the output signal of the AND gate 68 is now having the 'L' level, but the output signal of the NOR gate 65 is now having the 'H' level.

Meanwhile, one input of the exclusive-OR gate 66 receives the bit $SIGN_1$ which is now set at the 'L' level. Therefore, the level of the state signal LT depends upon the result of comparison outputted from the comparator 44.

As described before, the final address ODP is supplied to the input terminal A of the comparator 44, while the aforementioned sum data, outputted from the adder 52, is supplied to the input terminal B of the comparator 44. Thus, the level of the state signal LT depends upon the relationship between the numbers respectively supplied to the input terminals A and B of the comparator 44; in other words, the read address RP, which is outputted from the selector 45, is determined by that relationship.

Next, the operations of the circuitry shown in FIG. 4 will be described in detail in connection with each of the numerical states which are represented by inequalities for the final address ODP against the sum of the offset address OFP, the modulation data MOD and the number '−10000'.

(i) First state where ODP>OFP+MOD+'−10000' (ζ)

The first state, where the final address ODP is greater than the sum of the offset address OFP, the modulation data MOD and the number '−10000', corresponds to the duration ζ in which in FIG. 9A, a curve "OFP+MOD" is below a line "ODP+10000" but is greater than the number 'FFFF'. In that state, the comparator 44 outputs the result of comparison 'L'. Hence, the state signal LT has the 'L' level, so that the selector 45 selects the input terminal A. As a result, the following equation is established.

*RP=OFP+MOD+'−10000'*

Thus, the musical tone signal is read from the RAM 17 in response to the above-defined read address RP.

(ii) Second state where ODP≦OFP+MOD+'−10000' (η)

The second state, where the final address ODP Is smaller than or equal to the sum of the offset address OFP, the modulation data MOD and the number '−10000', corresponds to the duration η in which in FIG. 9A, the curve "OFP+MOD" is above the line "ODP+10000". In that state, the comparator 44 outputs the result of comparison 'H'. Hence, the state signal LT has the 'H' level, so that the selector 45 selects the input terminal B. As a result, the following equation is established.

RP=ODP

Thus, the musical tone signal is read from the RAM 17 in response to the above-defined read address RP.

In the duration η, which is similar to the aforementioned duration β, the write address WP advances ahead of the read address RP because of the relatively small speed in the decrease of the read address RP.

The present embodiment is designed such that In the duration η, the read address RP is replaced by the final address ODP indicating the longest delay time. Thus, it is possible to avoid the discontinuity in level of the musical tone signals to be read out.

①—2 Second condition where OFP+MOD≦'FFFF' (θ)

In the second condition, the comparator 46 outputs the result of comparison 'L'. The second condition, where the sum of the offset address OFP and the modulation data MOD, is smaller than or equal to the number 'FFFF', corresponds to the duration θ in which in FIG. 9A, the curve "OFP+MOD" is less than the number 'FFFF' but is above a line "OFP". The state where the curve "OFP+MOD" is above the line "OFP" indicates the state where the modulation data MOD is greater than or equal to zero (i.e., MOD≧0).

Since the comparator 46 outputs the result of comparison 'L' under the current condition where ODP<OFP and MOD≧0, the output level of the AND gate 63 turns to be at the 'L' level. Therefore, the OR gate 61 produces the output level 'L', so that the selector 47 selects the input terminal A. This input terminal A receives the result of addition of the adder 51, i.e., the data indicating the sum of the offset address OFP and the modulation data MOD. Hence, this data is supplied to the input terminal A of the selector 45 through the input terminal A of the selector 47.

Under the condition where the comparator 46 outputs the result of comparison 'L', the AND gate 68 produces the output level 'H'. Therefore, the output signal of the NOR gate 65 has the 'L' level. Thus, the selector 45 normally selects the input terminal A, regardless of the result of comparison of the comparator 44. As a result, the following equation is established.

*RP=OFP+MOD*

Thus, the musical tone signal is read from the RAM 17 in response to the above-defined read address RP.

② Second situation where MOD<0 (ι and κ)

Next, the description will be given with respect to the situation where the write address WP exists In the range Q and the sign of the modulation data MOD is negative.

The second situation, where the sign of the modulation data MOD is negative, corresponds to durations ι and κ shown in FIG. 9A. In that situation, the bit $SIGN_1$ has the 'H' level. Thus, the selector 42 selects the input terminal B, so that the write address WP is delivered to the input terminal A of the comparator 44 and the Input terminal B of the selector 45.

In the situation, the range of the numbers, which can be set for the offset address OFP, exists between the numbers '0' and 'FFFF'. Under the consideration of the range set for the offset address OFP, the following inequality is established.

$$OFP+MOD \leqq \text{'FFFF'}$$

Hence, the comparator 46 produces the result of comparison 'L'.

Thus, the output signal of the AND gate 63 has the 'L' level. Since the output level of the AND gate 62 has been already set at the 'L' level, the output level of the OR gate 61 is now set at the 'L' level. As a result, the selector 47 selects the input terminal A which receives the result of addition of the adder 51. Therefore, the sum of the offset address OFP and the modulation data MOD is delivered to the input terminal B of the comparator 44 and the input terminal A of the selector 45.

Since the bit $SIGN_1$ is set at the 'H' level, the output level of the AND gate 68 is set at the 'L' level. In this case, the output level of the AND gate 67 has been already set at the 'L' level; hence, the output level of the NOR gate 65 is now set at the 'H' level.

By the way, one input of the exclusive-OR gate 66 receives the bit $SIGN_1$ which is set at the 'H' level, while one input of the AND gate 64 receives the output signal of the NOR gate 65 which is set at the 'H' level. Thus, the level of the state signal LT, which is outputted from the AND gate 64, depends upon the result of comparison of the comparator 44.

In short, the level of the state signal LT and the read address RP are determined by the numerical relationship between the numbers respectively supplied to the input terminals A and B of the comparator 44. Herein, the input terminal A receives the write address WP, while the input terminal B receives the sum of the offset address OFP and the modulation data MOD.

Next, the computation of the read address RP will be described in connection with each of the numerical states which are established between the numbers supplied to the respective input terminals of the comparator 44.

(i) First state where WP≦OFP+MOD (ι)

The first state, where the write address WP is smaller than or equal to the sum of the offset address OFP and the modulation data MOD, corresponds to the duration ι (see FIG. 9A). In that state, the comparator 44 produces the result of comparison 'H'; hence, the state signal LT has the 'L' level, so that the selector 45 selects the input terminal A. As a result, the following equation is established.

$$RP=OFP+MOD$$

Thus, the musical tone signal is read from the RAM 17 in response to the above-defined read address RP.

(ii) Second state where WP>OFP+MOD (κ)

The second state, where the write address WP is greater than the sum of the offset address OFP and the modulation data MOD, corresponds to the duration κ (see FIG. 9A). In that state, the comparator 44 produces the result of comparison 'L'. Hence, the state signal LT has the 'H' level, so that the selector 45 selects the input terminal B. As a result, the following equation is established.

$$RP=WP$$

Thus, the musical tone signal is read from the RAM 17 in response to the above-defined read address RP.

In the duration κ which is similar to the aforementioned duration ε, the read address RP advances ahead of the write address WP because of the relatively large speed in the decrease of the read address RP.

However, the present embodiment is designed such that in the duration κ, the write address WP, indicating the shortest delay time (i.e., zero), is used as the read address. Thus, it is possible to avoid the discontinuity in level of the musical tone signals.

Figure 9B:
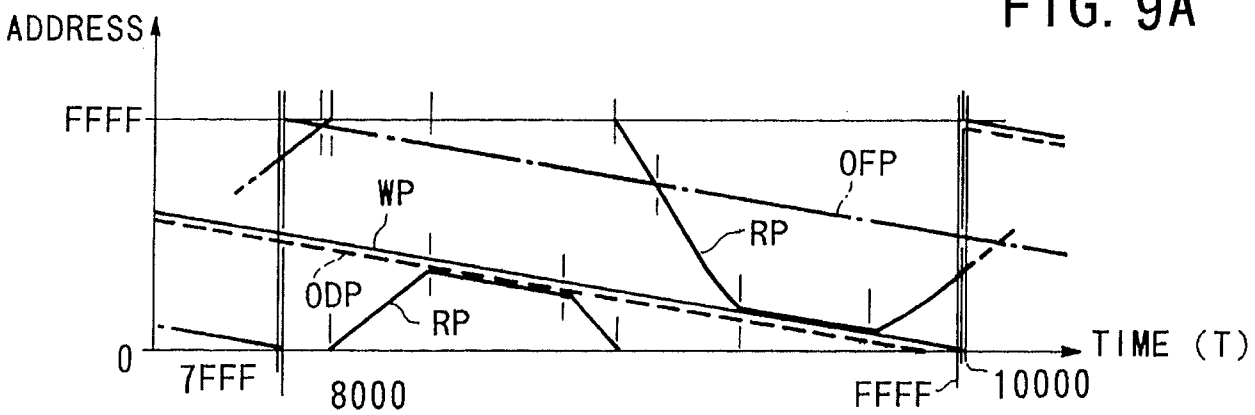

FIG. 9B shows a manner of variation of the read address RP, wherein FIG. 9B corresponds to FIG. 9A. FIG. 12 shows an example of the relationship among the durations ζ to κ in connection with the situation where ODP<OFP. In this situation, the durations ζ, η and θ emerge under the state where MOD≧0, while the durations ι and κ emerge under the state where MOD<0. Herein, the equation for the computation of the read address RP is described with respect to each duration.

(c) Exceptional range for the range Q (WP='0000', ODP='FFFF')

Figure 10:
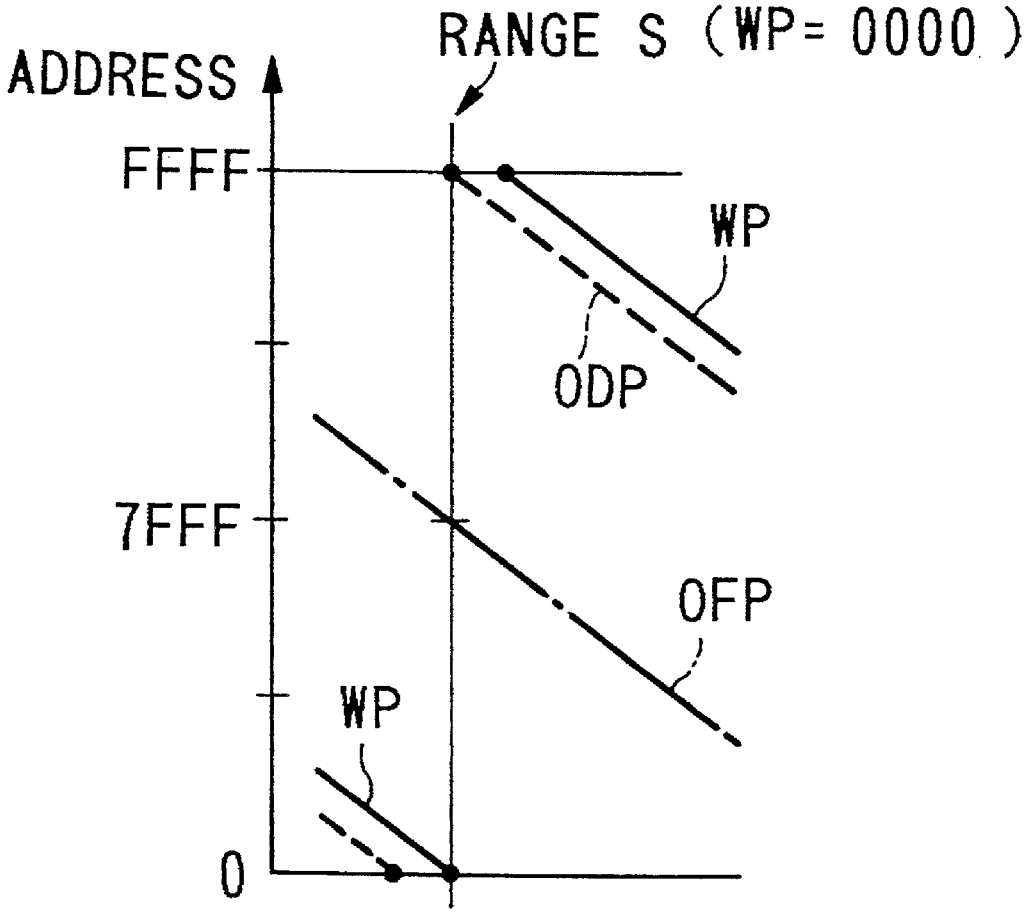
FIG. 10 is a graph which is used to explain the operation of the address-limit circuit in a range S.

When the write address WP reaches the number '0000', the final address ODP reaches the number 'FFFF', while the offset address OFP reaches the number '7FFF' as shown in FIG. 10. At this time, both of the comparators 41 and 43 output the result of comparison 'L'.

Thus, both of the AND gates 62 and 63 produce the output level 'L'. As a result, the output level of the OR gate 61 is set at the 'L' level, so that the selector 47 selects the input terminal A which receives the result of addition of the adder 51. Hence, the sum of the offset address OFP and the modulation data MOD is delivered to the input terminal B of the comparator 44 and the input terminal A of the selector 45.

Further, both of the AND gates 67 and 68 produce the output level 'L', so that the output level of the NOR gate 65 is turned to be at the 'H' level. As a result, the level of the state signal LT depends upon the output signal of the exclusive-OR gate 66. That is, the level of the state signal LT turns to the 'L' level when the output level of the exclusive-OR gate 66 is at the 'L' level, whereas the level of the state signal LT turns to the 'H' level when the output level of the exclusive-OR gate 66 is at the 'H' level.

Next, the computation for the read address RP will be described in connection with the positive/negative sign of the modulation data MOD which will determine the output level of the exclusive-OR gate 66.

① First situation where MOD≧0

In the first situation where the modulation data MOD is equal to or greater than zero, the bit $SIGN_1$ has the 'L' level. In that situation, the level of the state signal LT turns to the 'H' level only when the comparator 44 produces the result of comparison 'H'. In the first situation, the selector 42 selects the input terminal A which receives the final address ODP. Hence, the final address ODP is delivered to the input terminal A of the comparator 44 and the input terminal B of the selector 45.

Therefore, the level of the state signal LT turns to the 'H' level only when the comparator 44 Judges that the following inequality is established for the final address ODP against the sum of the offset address OFP and the modulation data MOD.

$$ODP \leqq OFP+MOD$$

When the above inequality is established, the selector 45 selects the input terminal B which receives the final address ODP through the selector 42. Thus, the following equation is established.

$$RP=ODP$$

On the other hand, the level of the state signal LT turns to the 'L' level only when the comparator 44 judges that the following inequality is established.

$$ODP>OFP+MOD$$

When the above inequality is established, the selector 45 selects the input terminal A which receives the result of addition of the adder 51 through the selector 47. Thus, the following equation is established.

$$RP=OFP+MOD$$

② Second situation where MOD<0

In the second situation where the modulation data is smaller than zero, the bit $SIGN_1$ has the 'H' level. Therefore, the level of the state signal LT turns to the 'H' level only when the comparator 44 produces the result of comparison 'L'. In the second situation, the selector 42 selects the input terminal B which receives the write address WP. Hence, the write address WP is delivered to the input terminal A of the comparator 44 and the input terminal B of the selector 45.

Therefore, the level of the state signal LT turns to the 'H' level only when the comparator 44 judges that the following inequality is established for the write address WP against the sum of the offset address OFP and the modulation data MOD.

$$WP>OFP+MOD$$

When the above inequality is established, the selector 45 selects the input terminal B which receives the write address WP through the selector 42. Thus, the following equation is established.

$$RP=WP$$

On the other hand, the level of the state signal LT turns to the 'L' level only when the comparator 44 judges that the following inequality is established.

$$WP>OFP+MOD$$

When the above inequality is established, the selector 45 selects the input terminal A which receives the result of addition of the adder 51 through the selector 47. Thus, the following equation is established.

$$RP=OFP+MOD$$

Therefore, under the precondition where the write address WP has the number '0000', the read address RP can be expressed by the following equations in connection with respective conditions (i), (ii) and (iii).

(i) First condition where WP<OFP+MOD<ODP

In the first condition, the write address WP is set at the number '0000' as described above, while the final address ODP is set at the number 'FFFF'. In that condition, the read address RP can be calculated by the following equation.

$$RP=OFP+MOD$$

(ii) Second condition where OFP+MOD≧ODP

In the second condition, the final address ODP is set at the number 'FFFF'. In that condition, the read address RP can be expressed by the following equation.

$$RP=ODP$$

(iii) Third condition where OFP+MOD≦WP

In the third condition, the write address WP is set at the number '0000' as described above. In that condition, the read address RP can be expressed by the following equation.

$$RP=WP$$

In the present embodiment described heretofore, the sum of the modulation data MOD and the offset address OFP is originally used as the read address; however, the number of the read address is limited by the address-limit circuit 84 to a certain number which exists within a range between the write address WP and the final address ODP. The modulation data MOD is obtained by performing a certain computation using the output signal of the low-frequency oscillator and the signal representative of the amount of manipulation applied to each of the manual-operable members $\mathbf{12}_1$ to $\mathbf{12}_n$. Hence, the value of the modulation data MOD is determined arbitrarily. However, even if the value of the modulation data MOD computed exceeds beyond a expected range, the read address RP is limited within a range between the write address WP and the final address ODP in response to a counted state for each of the write address WP and the offset address OFP. As described before, the noises may be occurred due to the discontinuity in level of the data; however, the present embodiment is advantageous in that the occurrence of the noises can be avoided without paying an attention to the number of the manual-operable members provided and their sensitivity. In addition, the present embodiment provides the LED 19 which is turned on to inform the performer of an occurrence of the overmodulation state. Thus, the performer can easily respond to the occurrence of the overmodulation state. For example, the overmodulation state can be canceled by reducing a degree of modulation.

For convenience's sake, the present embodiment uses the data, regarding the sine wave, for the modulation data MOD. However, the address-limit circuit 34 described before is designed to respond to all of the situations to be occurred. Hence, it is possible to use any data, other than the data regarding the sine wave, for the modulation data MOD.

Further, the maximum address of the RAM 17 is set at the number 'FFFF' in the present embodiment. However, the present invention is not limited to that. In other words, it is possible to use any number as the maximum address of the RAM 17. For example, if the number, represented by a symbol 'MAX', is used as the maximum address of the RAM 17, this number MAX is supplied to the input terminal B of the comparator 46. In addition, a number, represented by an expression of "—MAX–1", is supplied to the input terminal A of the selector 48, while another number, represented by an expression of "MAX+1", is supplied to the input terminal B of the selector 48. In that case, the number, which is added to the write address WP by the full adder 33 (see FIG. 3), is set to a half of the number MAX, by which the offset address OFP is calculated.

In the electronic musical instrument described before, the level of the state signal LT turns to the 'H' level when the overmodulation state is detected. At this time, the LED 19 is turned on so as to inform the performer of the occurrence of the overmodulation state. The electronic musical instrument can be modified such that the gain is reduced by multiplying the modulation data by a certain coefficient whose number is smaller than '1'.

In the present embodiment, the dashed line (see FIG. 7), indicating a manner of variation of the offset address OFP, is located at the mid-place between two lines each indicating a manner of variation of the write address WP. However, it is possible to modify the present embodiment such that a manner of variation of the offset address OFP can be changed arbitrarily. Even if the offset address OFP is changed arbitrarily, the state signal LT acts effectively, regardless of the number of the offset address OFP.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A delay-time-modulation effecting apparatus comprising:

storage means for storing musical tone signals supplied thereto;

write-address generating means for generating a write address whose number circulates within a predetermined range of numbers at a predetermined speed;

modulation-address generating means for generating a modulation address whose number is varied in a lapse of time in response to a desired modulation effect to be realized;

computation means for performing a computation using the modulation address and an offset address, which is determined in advance in response to the write address, so as to produce a read address;

address-limiting means for limiting the read address such that the read address does not advance ahead of the write address; and read/write means for writing the musical tone signal into the storage means by the write address and for reading the musical tone signal from the storage means by the read address which is limited by the address-limiting means.

2. A delay-time-modulation effecting apparatus according to claim 1 further comprising a display means which initiates a visual display to inform a performer of an event in which the address-limiting means is activated to limit the read address.

3. A delay-time-modulation effecting apparatus comprising:

storage means for storing musical tone signals supplied thereto, said storage means having a storage area which is defined by an address range existing between a first address number and a last address number;

write-address generating means for generating a write address whose number circulates within the address range at a predetermined speed;

modulation-data generating means for generating modulation data whose value is varied in a lapse of time in response to a desired modulation effect to be realized;

computation means for performing a computation using the modulation data and an offset address, which is determined in advance in response to the write address, so as to produce a read address;

address-limiting means for limiting the read address in response to a numerical relationship between the write address and the modulation data such that the read address does not advance ahead of the write address; and read/write means for writing the musical tone signal into the storage means by the write address and for reading the musical tone signal from the storage means by the read address which is limited by the address-limiting means.

4. A delay-time-modulation effecting apparatus according to claim 3, wherein the number of the write address is decreased from the first address number to the last address number and is circulatorily varied within the address range.

5. A delay-time-modulation effecting apparatus according to claim 3, wherein the storage means is a random-access memory.

6. A delay-time-modulation effecting apparatus according to claim 3 further comprising means for generating a state signal which indicates an overmodulation state in which the read address advances fast to be ahead of the write address, so that the address-limiting means is activated when the state signal is generated.

7. A delay-time-modulation effecting apparatus according to claim 3 further comprising:

means for generating a state signal which indicates an overmodulation state in which the read address advances fast to be ahead of the write address, so that the address-limiting means is activated when the state signal is generated; and display means for initiating a visual display to inform a performer of an occurrence of the overmodulation state on the basis of the state signal.

* * * * *